US006547265B1

(12) United States Patent
Enge et al.

(10) Patent No.: US 6,547,265 B1
(45) Date of Patent: Apr. 15, 2003

(54) TRANSFER WHEELCHAIR

(76) Inventors: John Enge, P.O. Box 367, Dallas, OR (US) 97388; Eupha Lynne Coleman, P.O. Box 1063, Petersburg, AK (US) 99833

( * ) Notice: Subject to any disclaimer, the term of this patent is extended or adjusted under 35 U.S.C. 154(b) by 0 days.

(21) Appl. No.: 09/915,979

(22) Filed: Jul. 25, 2001

Related U.S. Application Data

(60) Provisional application No. 60/221,466, filed on Jul. 26, 2000.

(51) Int. Cl.[7] ..... A61G 3/00

(52) U.S. Cl. ..... 280/47.38; 280/250.1; 297/188.09; 135/66

(58) Field of Search ..... 297/440.16, 440.17, 297/411.41, 5, 188.09, DIG. 4; 135/66, 67; 280/47.34, 47.38, 250.1, 242.1

(56) References Cited

U.S. PATENT DOCUMENTS

| | | | | | |
|---|---|---|---|---|---|
| 2,466,204 | A | * | 4/1949 | Brown | 297/115 |
| 3,471,199 | A | * | 10/1969 | Kuhlmann | 297/411.41 |
| 3,654,643 | A | * | 4/1972 | Clanan | 135/67 |
| 3,769,638 | A | * | 11/1973 | Clanan | 297/118 |
| 3,990,745 | A | * | 11/1976 | Rodaway | 248/354.1 |
| 4,052,087 | A | * | 10/1977 | Gagliardi | 280/43 |
| 4,067,409 | A | * | 1/1978 | DiMatteo et al. | 180/6.5 |
| 4,266,305 | A | * | 5/1981 | Kavaloski et al. | 297/353 |
| 4,343,482 | A | * | 8/1982 | Wegner | 280/42 |
| 4,592,562 | A | * | 6/1986 | Strautnieks et al. | 280/250.1 |
| 4,679,259 | A | * | 7/1987 | DiMatteo et al. | 297/DIG. 4 |
| 4,819,286 | A | * | 4/1989 | Beauchamp | 297/188.09 |
| 4,872,223 | A | * | 10/1989 | Baird | 297/DIG. 10 |
| 4,888,833 | A | * | 12/1989 | Garcia et al. | 280/304.1 |
| 5,039,165 | A | * | 8/1991 | Rothman et al. | 297/338 |
| 5,255,934 | A | * | 10/1993 | Wilson | 180/907 |
| 5,380,034 | A | * | 1/1995 | Wilson | 280/30 |
| 5,438,722 | A | | 8/1995 | Jayamanne | |
| 5,498,065 | A | * | 3/1996 | Tosoni | 297/411.41 |
| 5,526,537 | A | * | 6/1996 | Conrad | 297/188.12 |
| 5,568,933 | A | * | 10/1996 | Mizuno | 280/250.1 |
| 5,725,275 | A | * | 3/1998 | Wigfall | 297/183.1 |
| 6,039,403 | A | | 3/2000 | Hargroder | |
| 6,086,085 | A | | 7/2000 | Larsson | |
| 6,154,899 | A | | 12/2000 | Brooke et al. | |
| 6,176,508 | B1 | * | 1/2001 | Malassigne et al. | 280/648 |
| 6,185,769 | B1 | | 2/2001 | Larisey, Jr. et al. | |
| 6,418,571 | B1 | * | 7/2002 | Cheng | 297/188.09 |

FOREIGN PATENT DOCUMENTS

| | | | | | |
|---|---|---|---|---|---|
| JP | 05253260 | A | * | 10/1993 | A61G/5/04 |

OTHER PUBLICATIONS

U.S. patent application Ser. No. 60/221,466, Coleman, filed Jul. 26, 2000.

U.S. patent application 60/221,466, Coleman, (Provisional App filed Jul. 26, 2000 which benefit claimed).

Coleman & Enge, (Invention Disclosure by Enge and Coleman Jul. 23, 1999).

* cited by examiner

*Primary Examiner*—Brian L. Johnson
*Assistant Examiner*—Kelly E Campbell
(74) *Attorney, Agent, or Firm*—Rose Jade

(57) ABSTRACT

A wheelchair apparatus that provides an unobstructed seating platform for loading and unloading the user; that does not require a caregiver to lift the user's entire body during transfer on to or off of the chair; that provides a seating platform that can be positioned directly over a bed thereby eliminating the need to carry or move a patient over a gap or across an entire bed; and that reduces the number of necessary transfers on and off the chair during a twenty-four hour period by providing an integral toileting platform thereby allowing the chaired user to stay in the chair while using a pre-existing toilet.

14 Claims, 3 Drawing Sheets

TRANSFER WHEELCHAIR

CROSS-REFERENCE TO RELATED APPLICATIONS

This application claims the benefit of U.S. Provisional Application No. 60/221,466, filed Jul. 26, 2000.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

This invention relates most generally to the mobility needs of disabled persons and the lifting strains experienced by caregivers in nursing homes or other care facilities. More specifically, the device pertains to a wheelchair that a user may enter or depart from the back or any other direction in a horizontal plane; that does not require a caregiver to lift the user's entire body during transfer on to or off the chair; and that reduces the number of necessary transfers on and off the chair during a twenty-four hour period by providing an integral toileting platform.

Wheeled chairs are well known and have generally been devised to increase the mobility of disabled persons. Many users, including hospital or nursing home patients, require the assistance of a caregiver in order to get into or out of a wheelchair.

Many injuries are suffered by users and caregivers alike when the chair user is being transferred from one chair or bed to another chair or bed. Often the caregiver must lift the patient's entire body, or seek to drag or otherwise maneuver the patient's body over a part of the chair, or across a gap between a bed and chair, or a chair and toilet seat. A spouse or paid caregiver may not have sufficient strength or endurance to repeatedly lift or position the chair user in the proper manner. Caregivers suffer muscle and skeletal injuries from repetitive lifting of patients in and out of beds, chairs, cars, etc. During a transfer, a patient can also be injured by being dropped, being scraped against a surface, or by being bruised. Injury and infection can also result from the patient not being moved often enough, especially for toileting purposes.

The need for assistance with transfers and a shortage of physically able caregivers can result in a patient not being transferred between locations often enough, and can significantly add to the emotional strain on family members who want or need to take care of a loved one.

Others have invented chairs that seek to benefit the user and the caregiving assistant during the transferring process.

U.S. Pat. No. 6,185,769 B1 (Larisey, Jr. et al, Feb. 13, 2001) and U.S. Pat. No. 6,154,899 (Brooke et al., Dec. 5, 2000) describe a resident transfer chair that movably adjusts between an upright chair position to a flat position, and thereby facilitates transfer of a user between a chair and a bed. The device speaks to benefiting both the user and caregiver, but does not speak to reducing the number of necessary transfers during a twenty-four hour period, and does not provide an integral toileting platform.

U.S. Pat. No. 6,086,085 (Larsson, Jul. 11, 2000) describes a wheeled platform with removable seat with armrests, that can be used for moving a seated user in or out of a car. The lower elongate trapezoidal frame of the chair allows the lower chair frame to slide underneath a car while delivering the upper chair seat platform on or near the car seat. Presumably, the user is then transferred from either the chair or car seat directly onto the other. The platform and seat may be removed from the chair frame and stored on the car seat. The disclosure for the invention does not mention any benefit to a caregiver, e.g., in eliminating the need to lift the person from the wheelchair seat onto the car seat or vice versa. The design of the chair does not allow the user to enter the seat from the back, to rotate 360 degrees around a vertical axis while seated in the chair, or to perform toileting activities while seated in the chair. The chair is longer than a standard sized wheelchair and would not be practical for use in a home environment, or in a standard sized bedroom or bathroom designed to accommodate a standard sized wheelchair.

U.S. Pat. No. 6,039,403 (Hargroder, Mar. 21, 2000) describes a shower/tub transfer chair that is designed to be used only in the shower/tub, and that can be easily disassembled for transport or storage. It does not speak to any other benefit to the user or caregiver.

U.S. Pat. No. 5,596,775 (DiMatteo, et al., Jan. 28, 1997) describes a patient transfer device that requires substantial modifications to an existing wheelchair and/or bed, and relies upon a transfer sheet and attendants. Although the disclosure speaks to benefiting the caregiver and patient, the device does not eliminate the number of transfers that must be made for toileting during a twenty-four hour period, and is not practical for short term use in a home environment.

U.S. Pat. No. 5,438,722 (Jayamanne, Aug. 8, 1995) describes a wheelchair that devises to help the caregiver avoid lifting the total body weight of the patient when moving a patient into or out of a hospital bed. The chair is designed to be mobilized only by the caregiver, and provides wheels and armrests that are specially sized and located to allow the chair seat to abut flush against a hospital bed. The chair can be arranged into a horizontal alignment, belted to a hospital bed, and the patient then transferred onto the chair while remaining in a horizontal position during the transfer. The transfer method does not eliminate the necessity of sliding the patient across a horizontal surface and scraping or bruising the patient thereby, or reduce the number of transfers necessary. The chair does not provide means to allow the patient to control his or her mobility.

What would be useful is a standard sized wheel chair that maximizes the independence, health, and safety of both the user and the caregiver(s). What would be useful is a chair that has a removable back and set of armrests thereby providing a seating platform with an unobstructed perimeter to allow the patient to be conveniently moved into or out of the chair from any direction in the horizontal plane. This would reduce the risk of injury presented to both the patient and the caregiver during transfers that would otherwise necessitate ineffective and dangerous positioning of the chair, patient and caregiver during the transfer.

What would also be useful is a standard sized wheel chair whose base frame would allow the chair to back-in over a bed and deliver or receive the patient thereto while minimizing the distance the patent must be rolled, carried, dragged or otherwise manipulated to effect the transfer, and thereby reducing the risk of injury to the caregiver and patient.

What would also be useful is a standard sized wheelchair that reduces the number of transfers that must be performed during a twenty-four hour period. What would be useful is a wheelchair that can back over a pre-exiting toilet, and that provides a built-in toileting platform and partially removable seating platform to conveniently allow the seated user to use the pre-existing toilet while remaining seated in the wheelchair, thus reducing the number of transfers that must be performed during a twenty-four hour period.

DETAILED DESCRIPTION OF THE INVENTION

Figure 1:
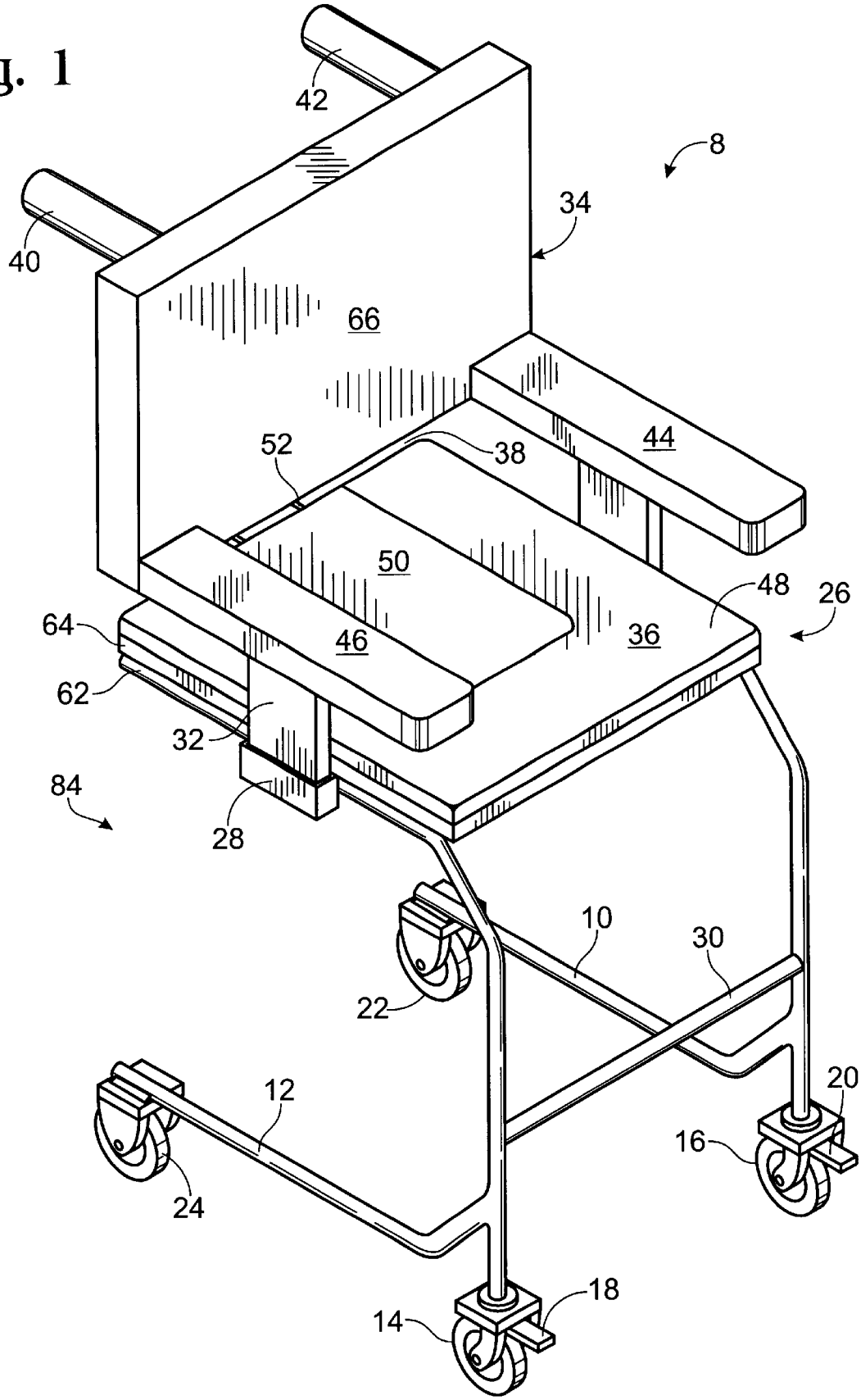
FIG. 1 is an isometric view of the wheelchair apparatus.

Referring now to the drawings in greater detail, FIG. 1 shows the preferred embodiment of wheelchair apparatus 8 comprising the present invention. It consists of a base frame 26 with integral toileting platform 64, a seating platform 48 for receiving a human user thereon, and removably attachable means 34 for supporting a user's torso and arms.

Figure 3:
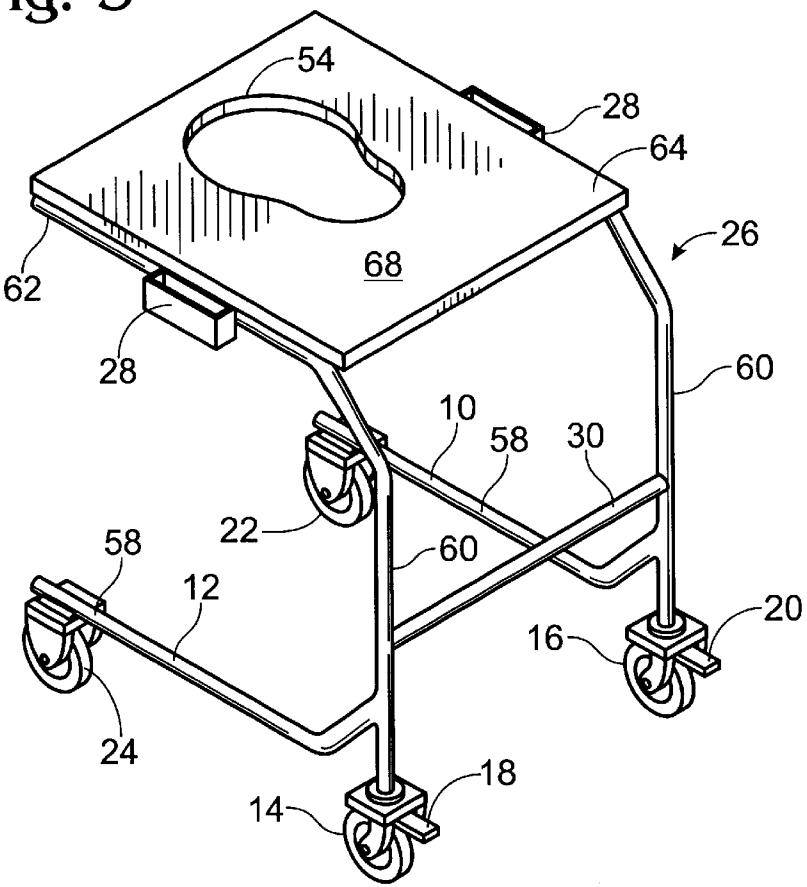
FIG. 3 is an isometric view of the base frame of the wheelchair apparatus shown in FIG. 1.

As shown in FIG. 3, in the preferred embodiment, frame 26 has two C-shaped legs 10, 12. Each leg 10, 12 has a lower horizontal first stem 58, a vertical second stem 60 continuing at an approximate right angle from first stem 58, and an upper horizontal third stem 62 continuing at an approximate right angle from second stem 60. First and third stems 58, 62 are of approximately equal length and are approximately parallel and opposite to each other, and in the same approximate plane. First and third stems 58, 62 are of standard length for a standard sized wheelchair, so no special widening of hallways or corridors is necessary to accommodate the invention beyond that used for standard sized wheelchairs. Use of a standard sized wheelchair requires a maneuvering corridor of approximately 1 meter/39.4 inches in width.

As shown in FIG. 3, frame 26 has means 30 for stabilizing legs 10, 12 to each other in the vertical plane. In the preferred embodiment as shown in FIG. 3, means 30 is a horizontal brace affixed to the vertical second stem 60 of each leg 10, 12.

As shown in FIG. 3, legs 10, 12 have a plurality of wheels 14, 16, 22, 24 attached thereto to allow frame 26 to roll along the ground. In the preferred embodiment as shown in FIG. 3, front wheels 14, 16 have means 18, 20, for pivoting and locking each front wheel 14, 16 to stabilize apparatus 8 during use or storage.

Figure 4:
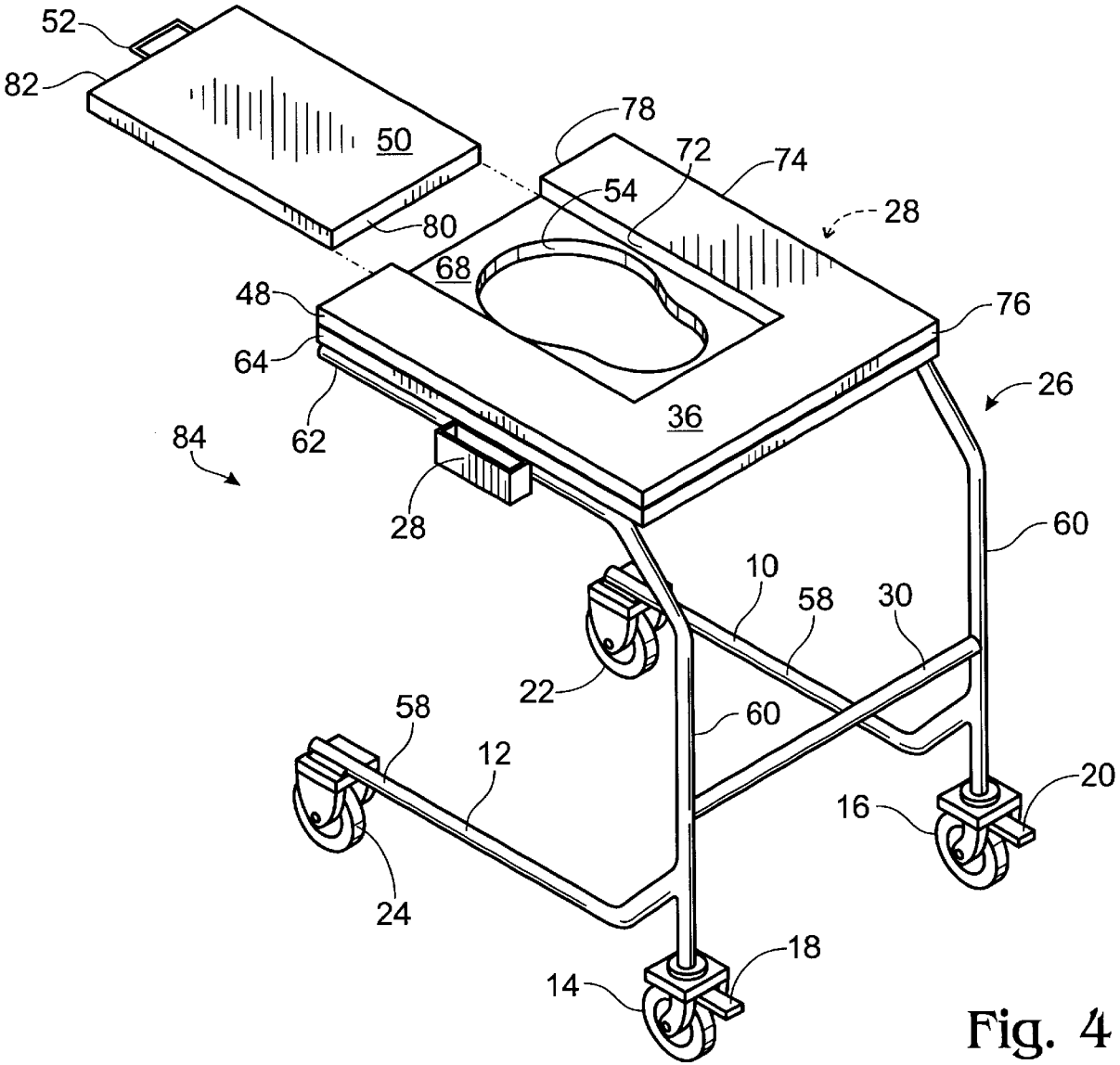
FIG. 4 is an isometric view of the base frame and two-part seating platform of the wheelchair apparatus shown in FIG. 1.

As shown in FIG. 3, each upper horizontal third stem 62 provides supporting means for toileting platform 64. Toileting platform 64 has means 54 for the passage of the user's bodily fluids into a toilet or other like receptacle. In the preferred embodiment as shown in FIG. 3, fluid passageway means 54 is a large aperture through toileting platform 64. As shown in FIG. 4, toileting platform 64 has an upper surface 68 for removably and fixedly receiving a seating platform 36.

Figure 2:
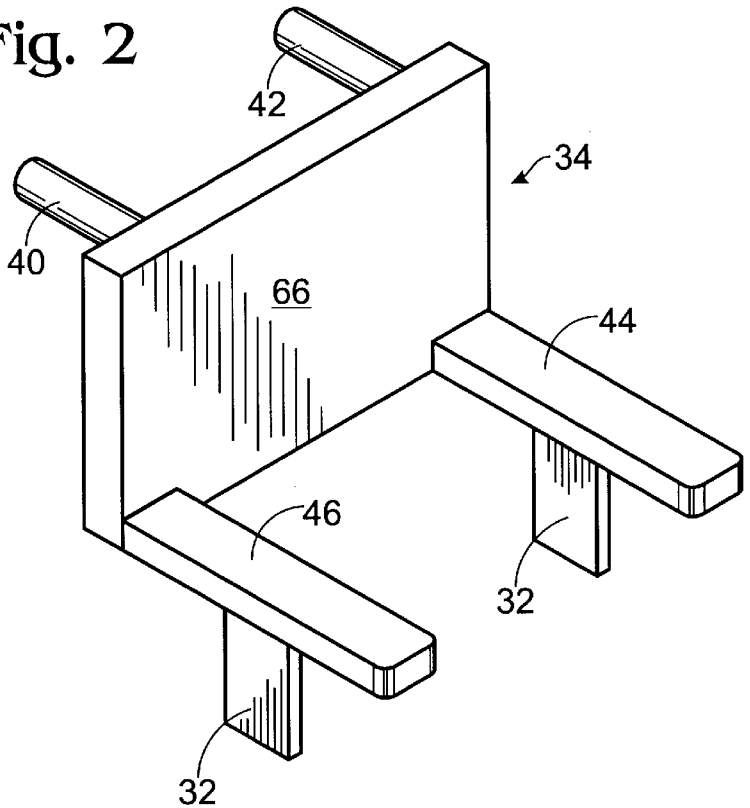
FIG. 2 is an isometric view of the removable chair back and arm rests of the wheelchair apparatus shown in FIG. 1.

As shown in FIG. 1, each upper horizontal third stem 62 also provides means 28 for removably receiving means 34 for supporting a user's torso and arms. In the preferred embodiment as shown in FIGS. 1 and 2, supporting means 34 consists of a removably attachable back support 66 with armrests 44, 46 and anchors 32 extending therefrom. In the preferred embodiment, receiving means 28 are rectangular shaped slots 28 extending outwardly from, and fixedly attached to, each stem 62, and are designed to receive rectangular chair back anchors 32. In the preferred embodiment, receiving means 28 are lockable.

As shown in FIG. 1, wheelchair apparatus 8 has a seating platform 48 for removably receiving a user on top of the toileting platform 64. As shown in FIG. 1, in the preferred embodiment, the front to back lengths of seating platform 48 and toileting platform 64, are approximately the same, and only slighter shorter than the front to back length of horizontal leg stems 58, 62. Leg stems 58, 62 are of a standard length, whereby use of apparatus 8 does not require widening of corridors or aisles beyond the width needed for a standard wheelchair. As shown in FIG. 4, the upper surfaces 36, 50 and outer perimeters 74, 82 of seating platform 64 are smooth and unobstructed. In particular, no part of base frame 26, including anchor receiving means 28, extends vertically above toileting platform 64. As shown by comparing FIGS. 1 and 4, when torso supporting means 34 is removed from apparatus 8, the horizontal path to and from seating platform 48 itself is unobstructed, and apparatus 8 can receive a user from any direction in the horizontal plane without the user needing to step or be lifted over or around arm rests 44, 46 or the seat back 66. Apparatus 8 thereby provides means for providing an unobstructed seating platform perimeter to a user entering or leaving said seating platform in any direction in the horizontal plane. Apparatus 8 thereby reduces the amount of lifting needed to be done by the user and/or caregiver, and also reduces the risk of injury to the user and/or caregiver during transfers of the user to or from the chair.

In the preferred embodiment, as shown in FIG. 4, platform 48 consists of a U-shaped first seat portion 36, and an approximately rectangular-shaped second seat portion 50. Second seating portion 50 removably fits into and abuts first seating portion 36 to form a solid rectangular shaped seating platform. First seat portion 36 is fixedly attached to toileting platform 64. First seat portion 36 has an inner first U-shaped perimeter edge 72, an outer second U-shaped perimeter edge 74, a front side 76 and a back side 78.

As shown in FIG. 4 second seat portion 50 has a front and side perimeter edge 80 and a back perimeter edge 82. Perimeter 80 matches the inner U-shaped perimeter 72 of first seating portion 36. Second seat portion 50 is removably attachable to toileting platform 68. In the preferred embodiment as shown in FIGS. 1 and 4, back edge 82 provides handling means 52 for a caregiver to manipulate when a seated user needs to use a toilet or other like receptacle. In the preferred embodiment, as shown in FIGS. 1 and 4, handling means consist of a strap loop 52, but other means could be used, such as integral grasp, a pull-string, etc. If toileting is done while torso support means 34 is attached to apparatus 8, a caregiver may move second seat portion 50 through chair back passageway means 38, as shown in FIG. 1.

As shown in FIG. 4, removal of seat portion 50 away from apparatus 8 provides passageway means for a user's bodily fluids to pass by first seat portion 36, and through seat platform 48, into toileting platform aperture 54.

Apparatus 8 may be backed over a toilet by positioning means 84 as shown in FIG. 1. In the preferred embodiment, positioning means 84 is the unobstructed area beneath the seating platform defined by the toileting platform 64 and between legs 10, 12. When a user is seated in apparatus 8, and apparatus 8 is positioned over a toilet, the removal of seat portion 50 provides means for the user to make use of toileting facilities without having to be transferred directly to and from the toilet. Apparatus 8 thereby reduces the number of transfers necessary for the user and his or her caregiver within a twenty-four hour period.

As shown in FIG. 1, in the preferred embodiment, chair apparatus 8 has handlebars 40, 42 extending backwardly from chair back 26 for a caregiver to hold and push against while moving chair 8.

A user may enter or leave chair apparatus 8 while back support 34 is in place, or while support 34 is removed from base frame 26.

A caregiver may assist a user, who is lying in a hospital bed, into the apparatus as follows. First, the caregiver wheels the chair down the pre-determined transfer aisle towards the pre-determined transfer side of the bed. Next, the back support 34 is removed from the frame base 26 and set proximate to the bed. The user is gently turned away from the transfer side of the bed, so his or her back is facing the transfer side of the bed, and room is made on the bed surface for the seating platform 36.

With the seating platform 36 in place on the toileting platform 26 as shown in FIG. 4, frame base 26 is wheeled from the transfer aisle into position proximate the bed, so that wheels 22, 24 and first leg stems 58 are under the bed, and wheels 14,16 and second leg stems 60 are aligned against the transfer side of the bed and in the transfer aisle. The bed mattress is thereby received within positioning aperture 84. Third leg stems 62 are positioned over the top of the bed, and seating platform 36 is thereby positioned parallel to and approximately flush with the bed surface. Wheels 14, 16 are then locked to secure the apparatus in place. Apparatus 8 may be backed over a bed due to the C-shape of legs 10, 12, and the positioning aperture 84.

Next, the patient is gently rolled back toward the transfer aisle and onto the seating platform 36, so that he or she is facing the ceiling and his or her buttocks are positioned on seating platform 36.

Thus, when back support means 34 is removed from base frame 26, seating platform 36 is unobstructed from every direction in the horizontal plane as shown in FIG. 4, and there is no need for the caregiver to lift the user's entire body to initially place the user's torso on the seating platform. Therefore it similarly does not matter at which end of the bed the patient's head is found at the beginning of the transfer, or to which left or right bed side the caregiver brings the chair apparatus.

Next, the caregiver slips one arm under the upper torso of the patient and the other arm proximate to the patient's legs, and assists the patient in sitting up while simultaneously swiveling the user approximately 90 degrees in the horizontal plane, so that the user's legs will hang down over horizontal brace 30. Again, because the seating platform is still unobstructed at this time, there is no need for the caregiver to lift the patient's entire body to put him or her in a final forward facing position in the chair. Apparatus 8 reduces the amount of lifting for the caregiver as well as reduces the risk of injury to the user and/or caregiver during a transfer.

Finally, back support 34 is installed by inserting anchors 32 into anchor apertures 28, and the user's torso then positioned on the support 34. The front wheels 14, 16 are unlocked. If the chair is motorized, the user may then move to another location without further assistance, or if necessary with the assistance of a caregiver. The process is reversed for transferring a patient from the chair apparatus into a bed.

It will be understood by those of ordinary skill in the art that other arrangements and disposition of the aforesaid components, the descriptions of which are intended to be illustrative only and not limiting, may be made without departing from the spirit and scope of the invention, which must be identified and determined from the following claims and equivalents thereof.

What is claimed is:

1. A chair apparatus comprising:

a base frame having two C-shaped legs, each said leg having a lower horizontal first leg stem, a front vertical second leg stem and an upper horizontal third leg stem, wherein said horizontal leg stems have approximately equal lengths, horizontal bracing means between the two said front vertical second leg stems, a toileting platform supported by said upper horizontal third leg stems, said toileting platform comprising an aperture for bodily fluids to pass there through and an upper surface for removably and fixedly receiving a seating platform, a plurality of anchor receiving apertures for removably receiving anchors, a plurality of wheels attached to each said C-shaped leg, and wherein no part of said base frame extends vertically above said toileting platform;

a seating platform removably and fixedly receivable by said toileting platform, comprising a front to back length approximately equal to the front to back length of said horizontal leg stems, said seating platform further comprising a first seating portion having an aperture for passage of bodily and other fluids therethrough and into said toileting platform aperture, and a second seating portion removably abutable to said first seating portion to thereby form a solid rectangular shaped seating platform;

removably attachable means for supporting a user's torso and arms comprising a chair back, arm rests extending therefrom, and an anchor depending from each said arm rest, said anchors removably receivable in said anchor receiving apertures of said base;

means for providing an unobstructed seating platform perimeter to a user entering or leaving said seating platform in any direction in the horizontal plane, said means comprising removal of said chair back and arm rests from said base frame; and a C-shaped positioning aperture comprising the unobstructed area beneath said seating platform and further defined by said toileting platform and the area between said C-shaped legs, whereby said seating platform and said upper horizontal third leg stems can be positioned over a bed mattress while said lower horizontal first leg stems are thereby positioned under the same mattress.

2. The apparatus of claim 1 wherein said anchor receiving apertures are lockable.

3. The apparatus of claim 1 wherein one or more said wheels are pivotable.

4. The apparatus of claim 1 wherein one or more said wheels are lockable.

5. The apparatus of claim 1 wherein said chair back further comprises two handlebars extending backwardly from the top of said chair back for use by a caregiver.

6. The apparatus of claim 1 wherein said anchor receiving apertures are lockable, and wherein one or more said wheels are pivotable, and wherein one or more said wheels are lockable, and where said chair back further comprises two handlebars extending backwardly from the top of said chair back for use by a caregiver.

7. The apparatus of claim 1 wherein said removably attachable means for supporting a user's torso and arms further comprises a chair back having an aperture proximate to said seating platform for movement of said second seating platform portion therethrough.

8. The apparatus of claim 1 wherein said first seating portion further comprises a U-shape having a first inner U-shaped perimeter edge, a second outer U-shaped perimeter edge, a front side, and a back side, and wherein said back side comprises said first inner U-shaped perimeter edge;

and wherein said aperture for said passage of bodily fluids through said first seating portion is U-shaped and defined by said first inner U-shaped perimeter;

and wherein said second seating portion comprises an approximately rectangular shape, and has a front edge removably abutable to said first inner U-shaped perimeter of said first seating portion, and a back edge further comprising handling means for moving said second portion away from or towards said first portion.

9. The apparatus of claim 8 wherein said anchor receiving apertures are lockable.

10. The apparatus of claim 8 wherein one or more said wheels are pivotable.

11. The apparatus of claim 8 wherein one or more said wheels are lockable.

12. The apparatus of claim 8 wherein said chair back further comprises two handlebars extending backwardly from the top of said chair back for use by a caregiver.

13. The apparatus of claim 8 wherein said anchor receiving apertures are lockable, and wherein one or more said wheels are pivotable, and wherein one or more said wheels are lockable, and where said chair back further comprises two handlebars extending backwardly from the top of said chair back for use by a caregiver.

14. The apparatus of claim 8 wherein said removably attachable means for supporting a user's torso and arms further comprises a chair back having an aperture proximate to said seating platform for movement of said second seating platform portion therethrough.

* * * * *